US005400537A

United States Patent [19]

Meller et al.

[11] Patent Number: 5,400,537

[45] Date of Patent: Mar. 28, 1995

[54] DOUBLE ACTION PISTOL WITH IMPROVED FIRING MECHANISM

[75] Inventors: Yehuda Meller, Holon, Israel; Tanfoglio Massimo, Gardone, Italy

[73] Assignee: Taas-Israel Industries, Ltd., Ramat-Hasharon, Israel

[21] Appl. No.: 998,438

[22] Filed: Dec. 30, 1992

[30] Foreign Application Priority Data

Dec. 30, 1991 [IL] Israel ..... 100548

[51] Int. Cl.[6] ..... F41A 19/12; F41A 19/14

[52] U.S. Cl. ..... 42/69.03; 89/147

[58] Field of Search ..... 42/69.03; 89/147

[56] References Cited

U.S. PATENT DOCUMENTS 5,160,796 11/1992 Tuma et al. ..... 89/147

5,166,458 11/1992 Yoo ..... 89/147

*Primary Examiner*—Stephen C. Bentley

*Attorney, Agent, or Firm*—Helfgott & Karas

[57] ABSTRACT

A double action pistol with a decocking mechanism as known per se, having an improved trigger mechanism by which the force that has to be exerted for firing the pistol from a decocked state is significantly smaller than with state of the art double action pistols.

1 Claim, 7 Drawing Sheets

DOUBLE ACTION PISTOL WITH IMPROVED FIRING MECHANISM

FIELD OF THE INVENTION

The present invention relates to a pistol and more specifically to a double action pistol with a decocking mechanism.

BACKGROUND OF THE INVENTION AND PRIOR ART

A double action pistol comprises among others a barrel with a breech at the rear end; a slide also known as breech block and bearing a firing pin; a trigger with associated trigger bar, sear and interruptor; a spring-loaded hammer; a magazine within a magazine chamber and a safety mechanism. During operation the slide slides back and forth between an advanced, firing position and a rear, cocked position. The forward movement is brought about by the expansion of so-called recoil springs which occurs when the trigger is pulled, and during this movement the slide strips a cartridge from the magazine and inserts it into the breech whereupon the hammer strikes the firing pin and the cartridge is fired. Upon firing, the propellant gas pressure pushes the slide rearwards whereby the recoil springs are compressed, the hammer is cocked and the pistol is ready for another firing round.

The magazine holds a limited number of ammunition rounds, say fifteen, and when in the course of operation the magazine is emptied it has to be replaced by a new, loaded one.

When the pistol has to be cocked manually by pulling the slide rearwards, the hammer is eccentrically tilted to the rear, thereby compressing the spring with which it is associated and thus creating a bias that upon release urges the hammer to swing forward and strike the firing pin inside the slide. As long as the trigger is not pulled, the sear locks the hammer in the cocked position. When the trigger is pulled, the rearward moving trigger bar pushes the sear out of engagement with the hammer whereupon the latter is released and strikes the firing pin.

In practice, it very often happens that in anticipation of a pistol shooting event a combatant cocks his pistol and switches the safety catch from the safe to the firing position. This, however, creates a dangerous situation in that any accidental shock or impact may release the hammer and cause the pistol to be fired. It is possible to cope with such a situation by manually decocking the hammer in guiding it gently into the forward position without allowing it to strike the firing pin. When now the trigger is pulled, the trigger bar will in a first phase, in collaboration with the sear and interruptor, recock the hammer. By further pulling the trigger it will, in a second phase, bring about the release of the hammer so that the latter may forcibly strike the firing pin, thereby triggering off the firing and subsequent recoiling operation.

In order to avoid the need for manual decocking, some double action pistols are provided with mechanical decocking mechanisms.

Decocking of a state of the art double action type pistol brings about the expansion of the compression spring associated with the hammer with the consequence that during the trigger pull phase at which the hammer is recocked, it is necessary to exert sufficient force for the recompression of the compression spring associated with the hammer. Depending on the type of pistol, a complete trigger pull may require the exertion of a force of the order of 6–10 kg, of which the first phase trigger pull accounts only for about 2–3 kg. Thus, where in a manually cocked conventional double-action pistol the hammer is decocked, the performance of the first shot requires the exertion of a substantial force. Apart from the intrinsic inconvenience, such exertion of force may and usually does cause inaccurate firing which, when bearing in mind that the first shot is very often the most critical, may have fatal consequences.

It is thus the object of the present invention to provide a double action pistol with a decocking mechanism as known per se, having an improved trigger mechanism by which the force that has to be exerted for firing the pistol from a decocked state is significantly smaller than with state of the art double action pistols.

SUMMARY OF THE INVENTION

In accordance with the present invention there is provided a double action pistol having a trigger with associated trigger bar, sear and interruptor, which trigger is of the kind which when pulled goes through first and second activation phases; a slide; a hammer and hammer associated compression spring which, when compressed, urges the hammer to strike the rear of the firing pin within the slide; and a decocking mechanism; characterized by:

i) a split hammer assembly comprising a first, power transmitting hammer member linked with the said compression spring and eccentrically swingable between a reclined, cocked position in which said compression spring is compressed and a forward position in which said compression spring is expanded; and a second, striking hammer member swingable between a reclined, cocked position and a forward position; said first and second hammer members being detachably coupled;

ii) a split sear assembly comprising a first sear member associated with said first hammer member, capable of reciprocating between an engaging position in which it engages said first hammer member and a disengaging position and biased into the engaging position; and a second sear member associated with said decocking mechanism and said second hammer member, reciprocable between an engaging position in which it engages said second hammer member and a disengaging position and biased into the engaging position; said first and second sear members being detachably coupled whereby when the trigger is pulled into said second activation phase both sear members are simultaneously shifted into the disengaging position.

The forward position of the second hammer member can be reached either in consequence of a second-phase trigger pull which results in firing of the pistol, or in consequence of decocking which does not result in firing.

When in a double action pistol according to the invention the decocking mechanism is operated, only the second, striking hammer member swings forward while the first, power transmitting hammer member remains in the cocked state. Consequently, for returning the second, striking hammer member from the fore to the reclining position, it is not necessary to recompress the hammer-associated compression spring which remains compressed even though the second, striking hammer member was decocked. As a result, during the second phase of a trigger pull, only a very small force is required for returning the second hammer member into the reclined position. Accordingly, in a pistol according to the invention the force required for triggering off a shot corresponds essentially to that required for the performance of the first phase of the trigger pull. Thus, as compared to state of the art double action pistols, the total force required for triggering off a shot in a double action pistol according to the invention is of the order of 2–3 kg as compared to 6–10 kg in state of the art pistols.

DESCRIPTION OF THE DRAWINGS

For better understanding, the invention will now be described, by way of example only, with reference to the annexed drawings without being limited thereto. In the drawings.

DESCRIPTION OF A SPECIFIC EMBODIMENT

Figure 1:
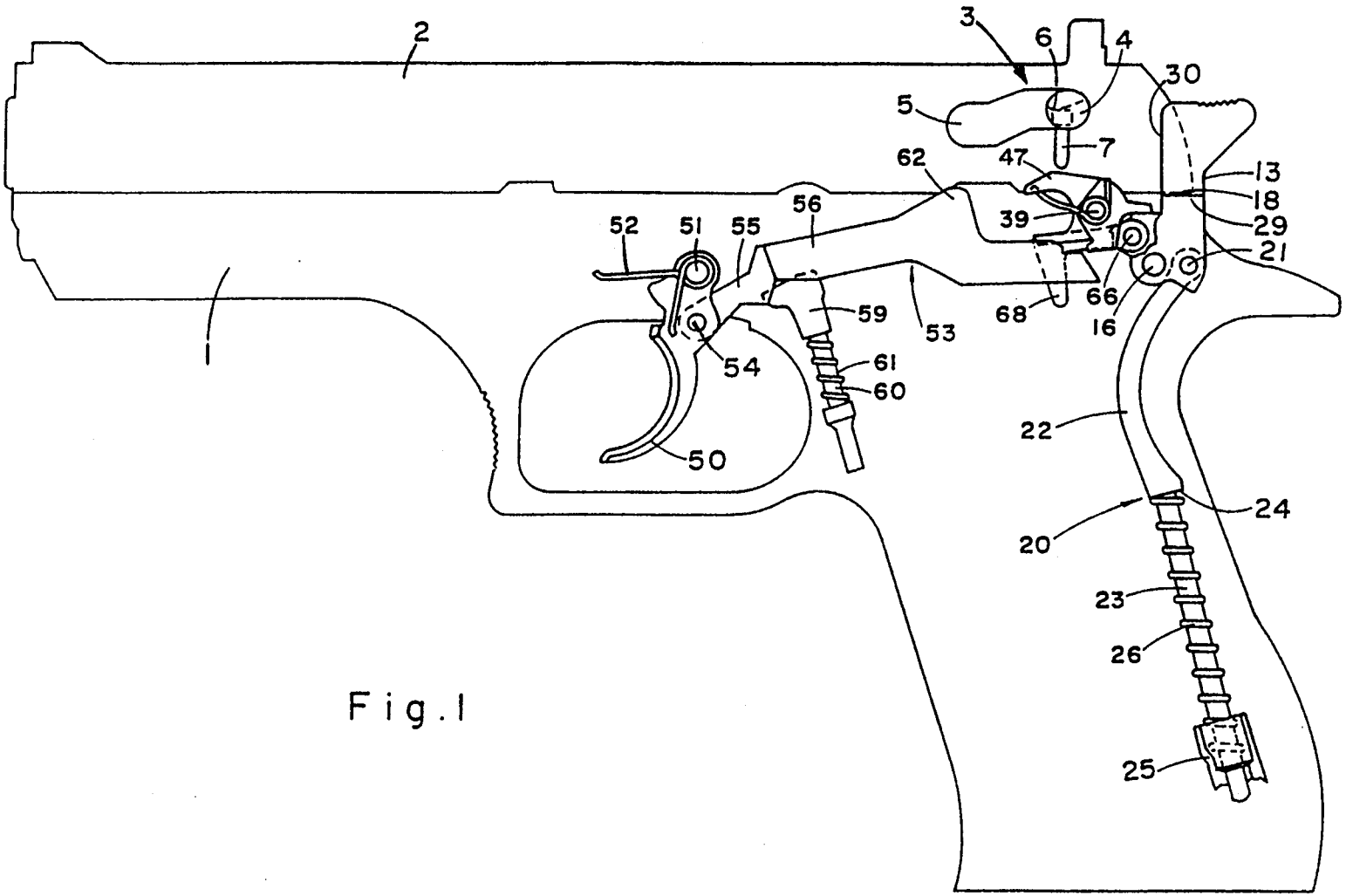
FIG. 1 is an elevation, partly broken open, of a pistol according to the invention showing the firing mechanism according to the present invention in the non-cocked state.
Figure 2:
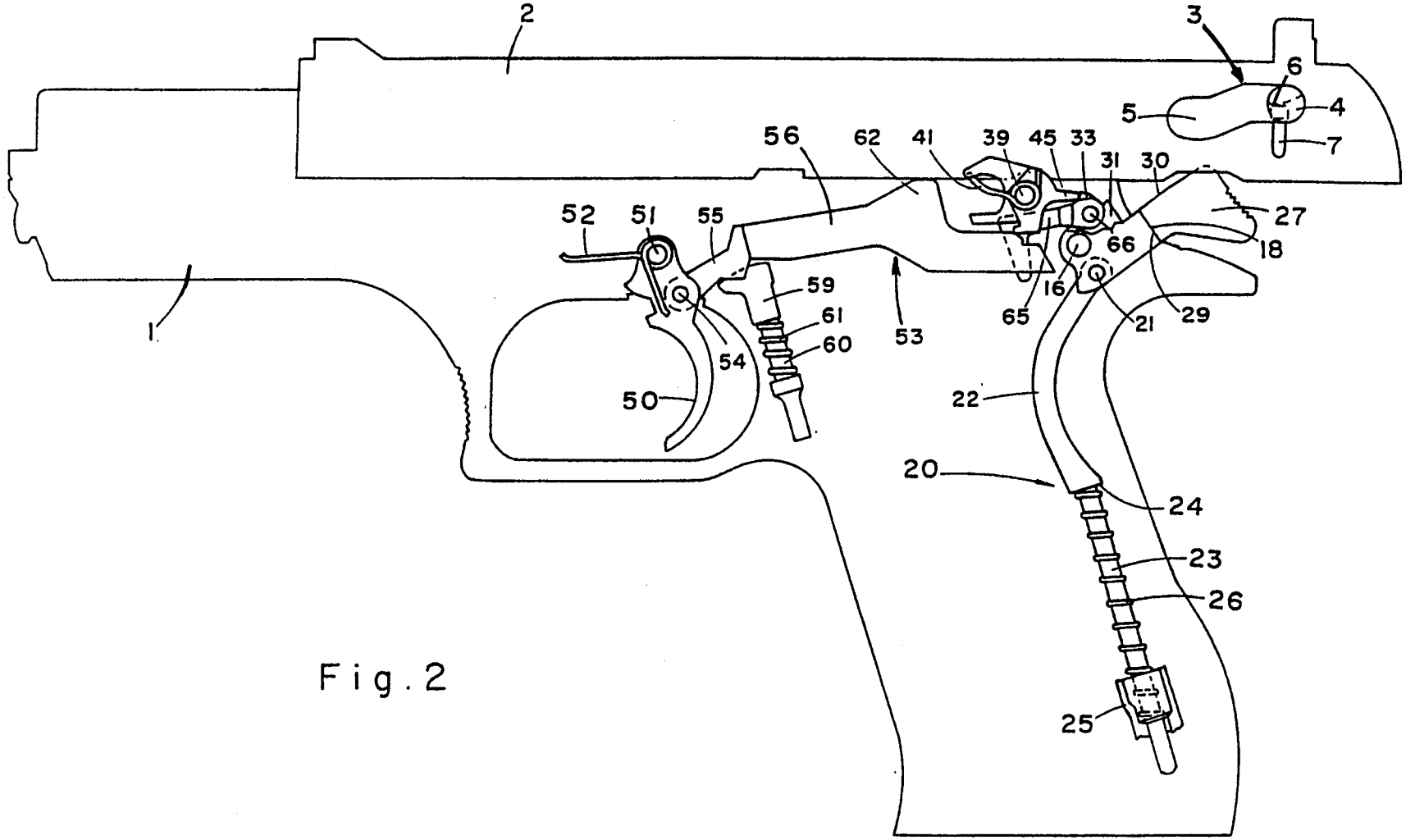
FIG. 2 is an elevation, partly broken open, of a pistol according to the invention showing the firing mechanism according to the present invention in the cocked state.

The double-action pistol according to the invention here shown has a housing 1 fitted with a slide 2 carrying a firing pin (not shown) and a safety catch 3 keyed on an axle 4 and fitted with an actuation lever 5. Axle 4 is mounted within a base in the slide and is rotatable therein for shifting between safe and firing positions. The internal end portion of axle 4 merges into an eccenter 6 adapted for cooperation with the head portion of an upward biased pin 7 (the biasing means not being shown) which, when lever 5 is shifted into the safe position, is depressed by eccenter 6 and when lever 5 is shifted into the firing position, moves up as the result of its upward bias.

Figure 5:
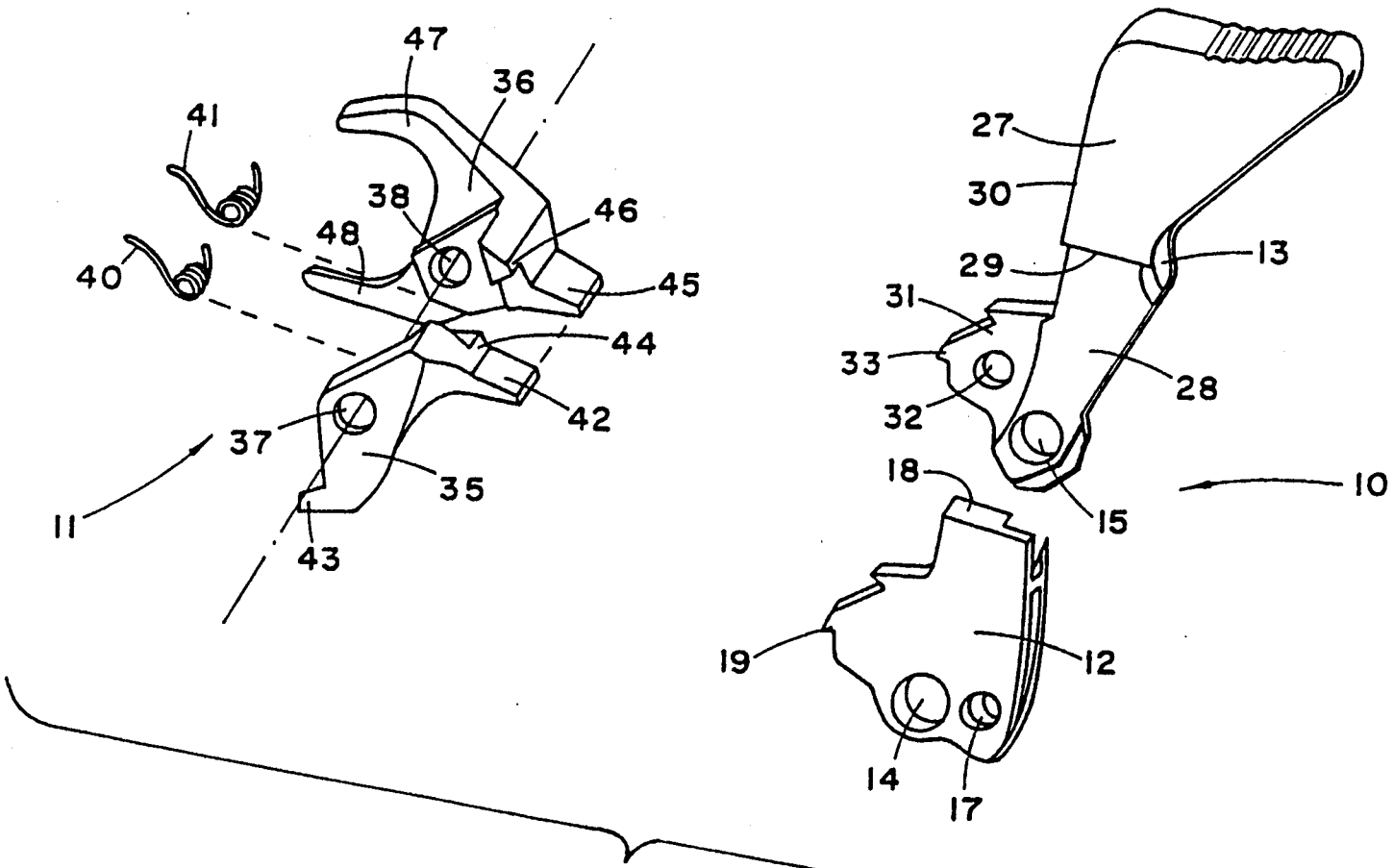
FIGS. 5 and 6 are isometric views of the sear and hammer members according to the present invention.
Figure 6:
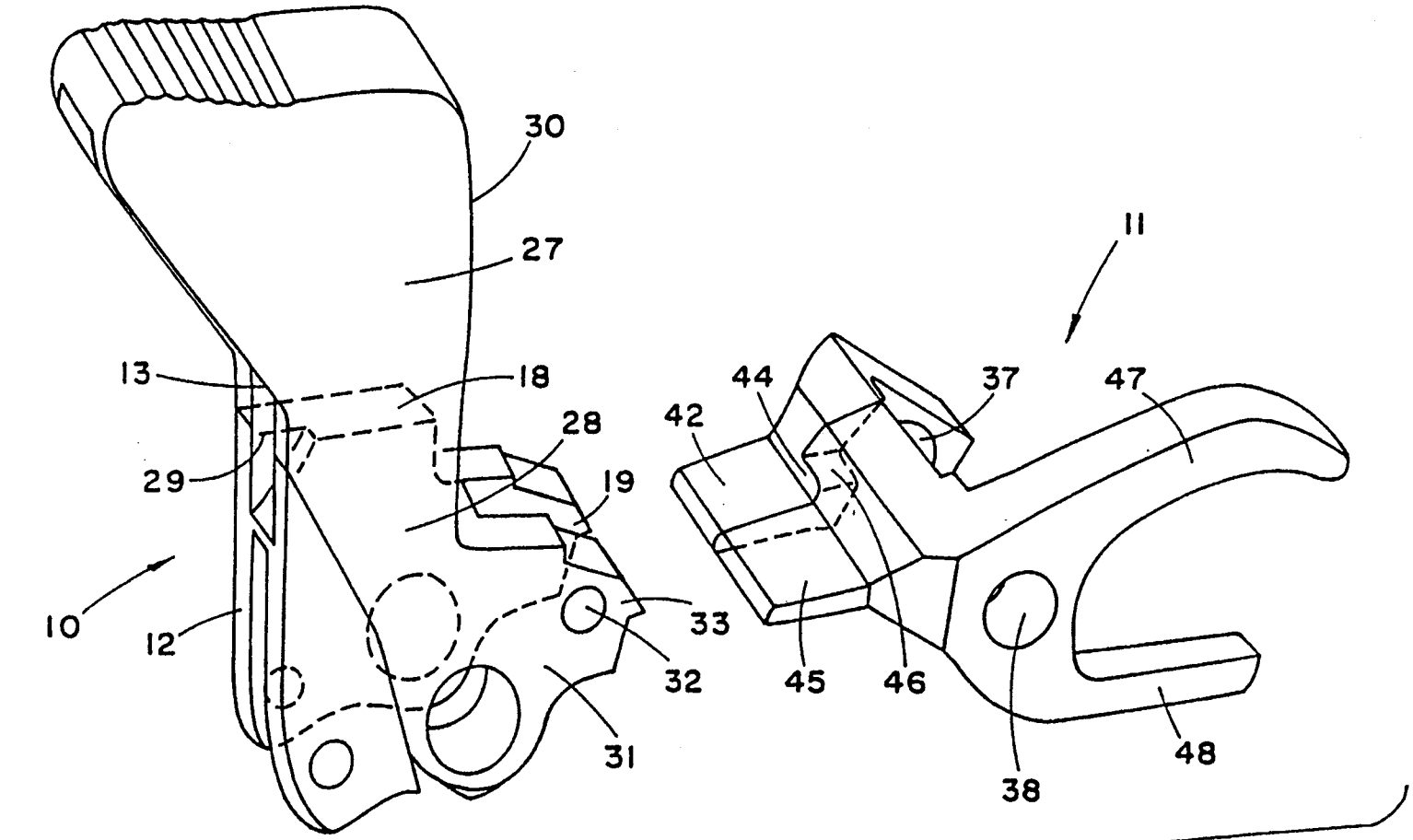
Figure 7:
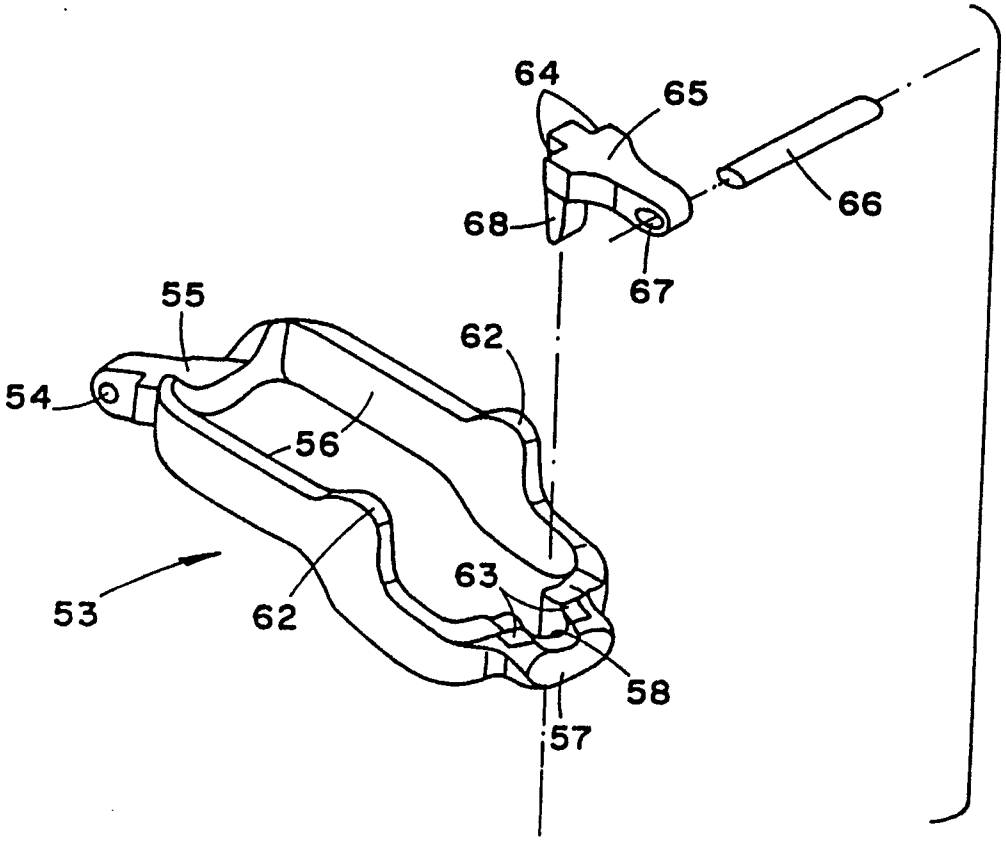
FIG. 7 shows isometrically the trigger bar and interruptor of the firing mechanism of FIGS. 3 and 4.

The firing mechanism in a pistol according to the invention comprises a split hammer assembly 10 and a split sear assembly 11 which will now be described with reference to FIGS. 5 and 6. As shown, the split hammer assembly 10 comprises a first, power-transmitting hammer member 12 and a second, striking hammer member 13. The hammer members 12 and 13 comprise registering holes 14 and 15 receiving an axle 16 journalled in body 1. The power-transmitting hammer member 12 comprises a further hole 17 which serves for linking to a hammer rod. The upper surface 18 of the first hammer member 12 serves for cooperation with the second hammer member 13 and a tooth 19 serves for cooperation with the sear.

A hammer rod 20 is pivotally linked to the first, power-transmitting hammer member 12 by means of a pin 21 engaging hole 17. Hammer rod 20 comprises an upper, arcuate portion 22 and a lower, straight cylindrical portion 23 with a shoulder 24 being formed between the two portions. Hammer rod portion 23 penetrates through the bottom of a cup 25 connected to the magazine portion of housing 1. A helical hammer spring 26 is coiled on the straight hammer rod portion 23 with its upper end bearing on shoulder 24 and the lower end being received in and bearing on the bottom of cup 25.

The second, striking hammer member 13 has an upper striking portion 27 and a lower, arm portion 28 forming between them a shoulder 29. The top side of the striking part 27 is knurled to provide for better grip in case of manual actuation and the front side 30 serves for striking.

The lower, arm portion of the second hammer member 13 has an integral bracket 31 comprising a hole 32 serving for linking to the interruptor, and a tooth 33.

The sear assembly 11 comprises a first sear member 35 and a second sear member 36 having registering holes 37 and 38 by which they are rotatably mounted on-an axle 39 journalled in housing 1, each with an anti-clockwise bias provided by helical springs 40 and 41, respectively. The first sear member 35 has an upper, rearward projecting bracket 42 for cooperation with tooth 19 of the first hammer member 12, and a lower, forward projecting bracket 43 for cooperation with the trigger mechanism. There is further provided a shoulder 44 for cooperation with the second sear member 36.

The second sear member 36 comprises a rearward projecting bracket 45 for cooperation with tooth 33 of the second hammer member 13, a lateral bracket 46 with a flat slanting bottom adapted for cooperation with the upper matching surface of shoulder 44 of the first sear member 35, an upper arm 47 for cooperation with pin 7 of the safety catch 3 and a lower arm 48 for cooperation with the trigger mechanism.

Attention is now directed to FIGS. 1 to 4 for the description of the trigger mechanism. As shown, the trigger mechanism comprises a trigger 50 pivoted to the housing at 51 with a bias into the forward, release position by means of a helical spring 52. A trigger bar 53 is pivotally linked to trigger 50 at 54. Trigger bar 53 comprises a shank 55 and a frame having two longitudinal frame members 56 extending each along one of the side walls of the magazine chamber, and a terminal lateral frame member 57 having a cavity 58. Trigger bar 53 is associated with a trigger plunger 59 reciprocable on a pin 60 mounted on housing 1 and loaded with a helical spring 61 which bears on a collar of pin 60 and provides an upward bias. Frame members 56 comprise each an upward projection 62 for cooperation with slide 2. Near their end portions frame members 56 have each a shoulder 63 for cooperation with matching shoulders 64 of an interruptor 65 linked to the second hammer member 13 by means of a pin 66 engaging hole 32 of bracket 31 of the second hammer member 13 and a registering hole 67 of the interruptor.

Interruptor 65 is hook-shaped having a downward projecting leg portion 68 which is accommodated within cavity 58 of the trigger bar frame member 57.

The operation of the pistol according to the invention as here described is as follows:

In the position shown in FIG. 1 the pistol is completely inactive. In this position the two hammer members 12 and 13 are coupled to each other in that the lower face of shoulder 29 bears on the upper surface 18 of the first hammer member 12. Likewise, the first and second sear members 35 and 36 are coupled in that the lower, slanted surface of bracket 46 of the second sear member bears on the matching surface of shoulder 44 of the first sear member. When now slide 2 is pulled manually to the rear into the position shown in FIG. 2, the two coupled hammer members 12,13 are forced to swing together into the reclined position in which brackets of 42 and 45 of sear members 35 and 36 engage, respectively, teeth 19 and 33 of the first and second hammer members 12 and 13. Due to the eccentricity of the link between hammer rod 20 and the second sear member 12, the hammer rod is pushed down as a result of the rearward swing of the first hammer member 12, whereby compression hammer spring 26 is compressed and the pistol is fully cocked. At this stage the user can choose between firing the pistol or decocking it.

Figure 3:
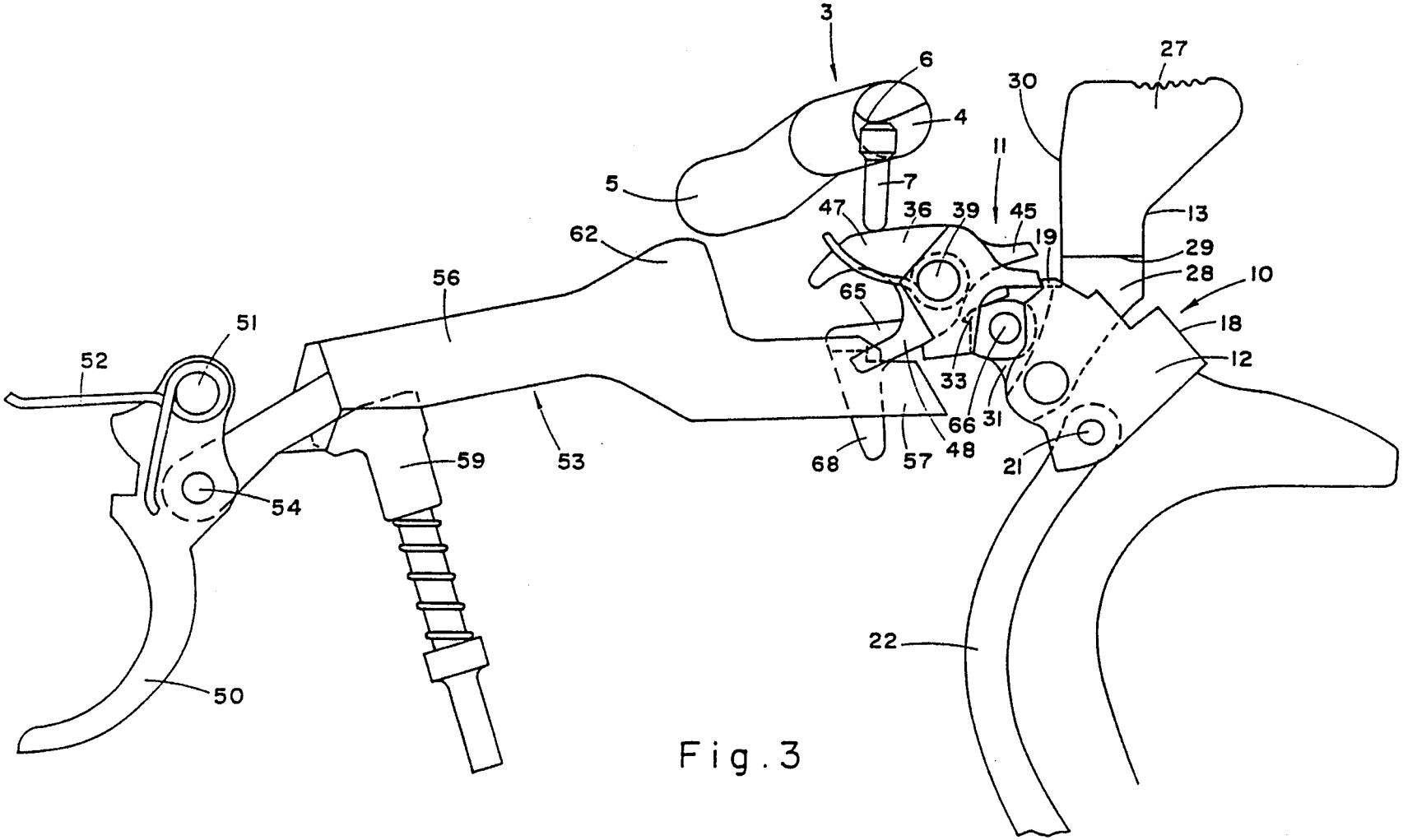
FIG. 3 is an elevational view of the firing mechanism in the pistol of FIGS. 1 and 2 in the decocked state, drawn to a larger scale and also showing the safety catch.
Figure 4:
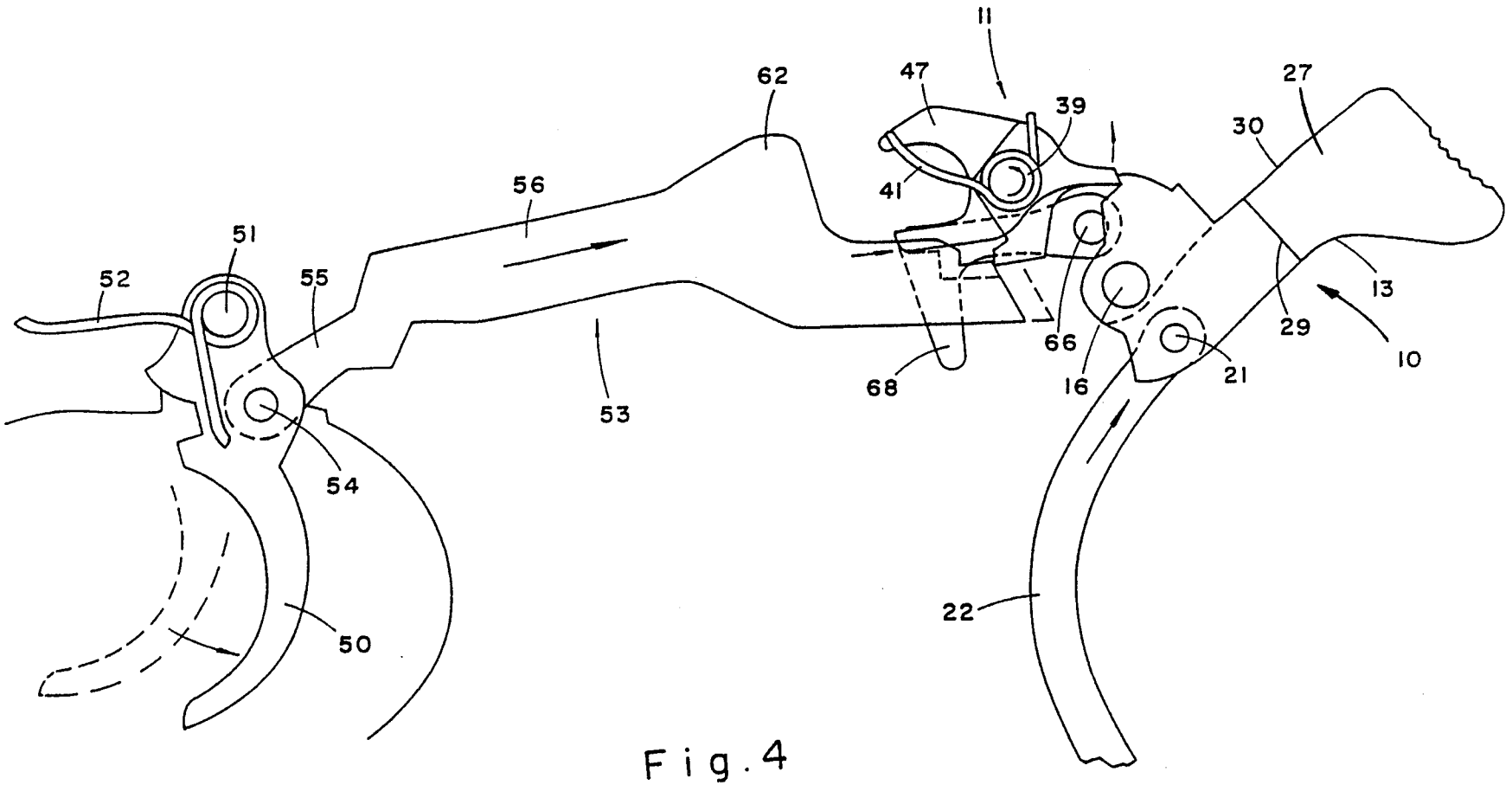
FIG. 4 is an elevational view of the firing mechanism in the pistol of FIGS. 1 and 2 in the fully cocked pre-firing state.

Attention is now directed to FIG. 3 for the description of the decocking operation. As shown, when lever 5 of the safety catch 3, is depressed, the apex of eccenter 6 of axle 4 depresses pin 7 which in turn depresses arm 47 of the second sear member 36 whereby the latter is turned anti-clockwise and projection 45 thereof disengages tooth 33 of the second hammer member 13. By the action of trigger spring 52 in combination with the biasing action of the trigger plunger 59, the trigger 50 is automatically pulled forward dragging with it trigger bar 53 and interruptor 65 which in turn, by its eccentric link at 66 to bracket 31 of the second hammer member 13, causes the latter to swing anti-clockwise into the upright, decocked position of FIG. 3. It should be noted here that because of the nature of the coupling between the first and second hammer members by which the coupling surface of shoulder 29 of the second hammer member 13, is uppermost, while the coupling surface 18 of the first hammer member 12 is lowermost, the second hammer member 13 can swing from the reclined position forward independent of the first hammer member 12. However, when the second hammer member serves as prime mover in the course of being reclined, it drags with it the first hammer member 12. Likewise, when the first hammer member 12 acts as prime mover in consequence of the action of the hammer spring 26, it pushes with it the second hammer member 13. Similarly, due to the nature and relative positions of the coupling surfaces of the two sear members 36 and 35, they remain coupled during cocking and firing, but the second sear member 36 can swing to the rear during decocking independent of the first sear member 35.

When lever 5 of the safety catch 3 is shifted into the safe position and the second sear member 36 is rotated anti-clockwise by the action of pin 7 on the upper arm 47 as specified, the lower arm 48 of the second sear member depresses trigger bar 53 against the bias of plunger 59 which puts the trigger bar out of engagement with shoulder 64 of interruptor 65 which in turn makes it impossible to shift the second hammer member 13 into the reclined position by pulling trigger 50. In this way a further safety means is provided.

For shooting, lever 5 of the safety catch 3 has to be shifted into the firing position whereby pin 7 is retracted in consequence of its upward bias and the second sear member 36 is free to swing clockwise by the action of its biasing spring 42 which enables the spring-biased plunger 59 to push the trigger bar 53 back into engagement with the interruptor 65. When now trigger 50 is pulled, the interruptor 65 pushes the second hammer member 13 back into the reclined position of FIG. 2 with the bracket 45 of the second sear member 36 snapping back into engagement with tooth 33 of the second hammer member 13. In that position both the first and second hammer members 12 and 13 and the first and second sear members 35 and 36 are again coupled. As the trigger bar 53 keeps moving backward shoulders 63 thereof engage shoulders 64 of the interruptor 65 whereby the second hammer member 13 is pushed into the reclined position of FIG. 4. At the same time the two coupled sear members 35 and 36 are caused to swing anti-clockwise clearing teeth 19 and 33 of the first and second hammer members 12 and 13, respectively. Upon this clearance, the hammer spring 26 is free to expand and forcibly drives the hammer rod 20 upwards which, in consequence of its eccentric linkage to the first sear member 12, causes the latter and the second hammer member 13 coupled therewith to forcibly swing anti-clockwise until the striking surface 30 of the second hammer member 13 strikes the firing pin whereby the pistol is fired. Upon firing the slide 2 is recoiled by the expanding combustion gases and the pistol can be fired again or, alternatively, be decocked as may be desired.

We claim:

1. A double action pistol having a trigger with associated trigger bar, sear and interruptor, which trigger is of the kind which when pulled goes through first and second activation phases; a slide; a hammer and hammer associated compression spring which, when compressed, urges the hammer to swing causing the pistol to fire; and a decocking mechanism; characterized by:

i) a split hammer assembly comprising a first, power transmitting hammer member linked with said compression spring and eccentrically swingable between a reclined, cocked position in which said compression spring is compressed and a forward position in which said compression sporing is expanded; and a second, striking hammer member swingable between a reclined, cocked position and a forward position; said first and second hammer members being detachably coupled;

ii) a split sear assembly comprising a first sear member associated with said first hammer member, said first sear member reciprocable between an engaging position in which it engages said first hammer member and a disengaging position and biased into the engaging position; and a second sear member associated with said decocking mechanism and said second hammer member, reciprocable between an engaging position in which it engages said second hammer member and a disengaging position and biased into the engaging position; said first and second sear members being detachably coupled whereby when the trigger is pulled into said second activation phase both sear members are simultaneously shifted into the disengaging position.

* * * * *